US006983739B2

(12) United States Patent
Suzuki

(10) Patent No.: US 6,983,739 B2
(45) Date of Patent: Jan. 10, 2006

(54) EVAPORATIVE FUEL CONTROL SYSTEM FOR INTERNAL COMBUSTION ENGINE

(75) Inventor: Ryoji Suzuki, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 11/134,524

(22) Filed: May 20, 2005

(65) Prior Publication Data

US 2005/0257607 A1 Nov. 24, 2005

(30) Foreign Application Priority Data

May 21, 2004 (JP) ..... 2004-151365

(51) Int. Cl.
*F02M 33/02* (2006.01)

(52) U.S. Cl. ..... 123/519

(58) Field of Classification Search ..... 123/198 D, 123/434, 518, 519, 520, 521
See application file for complete search history.

(56) References Cited

U.S. PATENT DOCUMENTS

| | | | | |
|---|---|---|---|---|
| 5,269,277 | A * | 12/1993 | Kuroda et al. | 123/518 |
| 5,373,823 | A * | 12/1994 | Kuroda et al. | 123/520 |
| 5,775,307 | A * | 7/1998 | Isobe et al. | 123/520 |
| 6,761,154 | B2 | 7/2004 | Takagi et al. | |
| 6,789,523 | B2 * | 9/2004 | Oki et al. | 123/198 D |
| 2004/0000187 | A1 | 1/2004 | Kobayashi et al. | |

FOREIGN PATENT DOCUMENTS

| | | |
|---|---|---|
| JP | 2003-013810 A | 1/2003 |
| JP | 2004-011561 A | 1/2004 |
| JP | 2004-028060 A | 1/2004 |

* cited by examiner

*Primary Examiner*—Bibhu Mohanty
(74) *Attorney, Agent, or Firm*—Flynn, Thiel, Boutell & Tanis, P.C.

(57) ABSTRACT

The present invention provides an evaporative fuel control system for an internal combustion engine. In this system, a canister is disposed on an evaporative fuel control passage that connects an intake passage of the engine with a fuel tank to absorb the evaporative fuel. An atmosphere open passage connects the canister with the atmospheric air. A purge valve is located between the intake passage and the canister for a purge control of the evaporative fuel generated in the fuel tank and absorbed by the canister. This system includes a switching valve, a reference pressure detecting means, a pressure reducing means, a leak diagnosis means, and a failure determination means. The switching valve communicates/shuts the atmosphere open air passage with/to the atmosphere. The pressure reducing means vacuums or reduces the pressure inside of the evaporative fuel control system. The leak diagnosis means diagnoses leakage within the evaporative fuel control system by using a reduced pressure in the evaporative fuel control system which is reduced by the pressure reducing means when the switching valve is shifted to shut the atmospheric air, and a reference pressure detected by the reference pressure detecting means. The failure determination means determines that the switching valve is in a state of failure by using a pressure variation when shifting of the switching valve for the leak diagnosis.

2 Claims, 6 Drawing Sheets

EVAPORATIVE FUEL CONTROL SYSTEM FOR INTERNAL COMBUSTION ENGINE

This application is 1 of 3 related, concurrently filed applications, all entitled "Evaporative Fuel Control System for Internal Combustion Engine", all having the same inventorship, and having Ser. Nos. 11/134,524, 11/134,525 and 11/134,523, respectively. The disclosures of the related co-pending applications are herein incorporated by reference.

FIELD OF THE INVENTION

This invention relates to an evaporative fuel control system for an internal combustion engine, and more particularly to the evaporative fuel control system which determines failure of a switching valve based on pressure variation used for leakage diagnosis control (leak check), thereby eliminating the need for any additional system or parts for failure determination.

BACKGROUND OF THE INVENTION

Traditional designs of internal combustion engines permit for unwanted air pollution and loss of fuel due to evaporation of fuel, containing hydrocarbon (HC), from the tank, the carburetor, and other engine component. There are known prior art to obviate these problems.

In particular, there is an evaporative fuel control system which employs a fuel vapor collection canister containing an adsorbent material, such as activated carbon, for adsorbing evaporative fuel, and a purge system for releasing the adsorbed fuel and supplying it to the engine during operation of the engine. See JP Laid-Open No. 2004-11561 and JP Laid-Open No. 2004-28060.

As shown in FIG. 3, the evaporative fuel control system 202 is associated with a conventional internal combustion engine.

This evaporative fuel control system 202 includes a canister 212, an atmosphere open passage 214, and a purge valve 216. The canister 212 is disposed on an evaporative fuel control passage 210 connecting a fuel tank 208 with an intake passage 206 in an intake pipe 204 of the engine (not shown) mounted on a vehicle (not shown). The atmosphere open passage 214 connects the canister 212 with the atmospheric air. The purge valve 216 is disposed between the intake passage 206 and the canister 212.

As shown in FIG. 3, the evaporative fuel control passage 210 connects the fuel tank 208 with the intake passage 206 on the downstream side of a throttle valve 218. A controller 224 is connected to the purge valve 216, a fuel level gauge 220 within the fuel tank 208, and a leak check module 222 associated with the atmosphere open passage 214.

As also shown in FIG. 3, the leak check module 222 is located on the atmosphere open passage 214 between the canister 212 and an air filter 226. This leak check module 222 includes first, second and third atmosphere open passages 214-1, 214-2, and 214-3. More particularly, the first atmosphere open passage 214-1 connects the canister 212 and the air filter 226 through a solenoid switching valve 228. The second atmosphere open passage 214-2 connects the canister 212 and the air filter 226 through the solenoid switching valve 228 and a pressure reducing pump 230. The third atmosphere open passage 214-3 connects the canister 212 and the air filter 226 through a reference orifice 232 and the pressure reducing pump 230. A pressure sensor 234 is disposed between the reference orifice 232 of the third atmosphere open passage 214-3 and the pressure reducing pump 230.

Further, the evaporative fuel control system 202 permits the canister 212 to absorb the evaporative fuel generated in the fuel tank 208, and supplies the evaporative fuel absorbed in the canister 212 to the intake passage 206 through the purge valve 216 for a purge control.

One method to examine leakage in the evaporative fuel control system 202 employs the pressure reducing pump 230 or the electric pump, the solenoid switching valve 228, and the reference orifice 232.

In this method, as shown in FIGS. 4 and 5, after activation of a leakage diagnosis system, the pressure reducing pump 230 or the electric pump is activated to vacuum or generate a negative pressure (pressure less than an ambient atmosphere), thereby causing the atmosphere through the reference orifice 232, and a reference pressure is measured.

Then as shown in FIGS. 4 and 6, the switching valve 228 is activated to vacuum the fuel tank, and a pressure is measured after elapse of predetermined time D. Thereby, it is determined whether there is leakage (large leakage which is greater than the reference pressure generated by the flow of atmosphere through the orifice) by comparing the pressure measured after predetermined time D with the reference pressure.

However, there is a possibility that the above-mentioned leakage diagnosis method determines that the evaporative system is in a normal condition without leakage, even if one of the components, the switching valve, is in failure.

There is a method to diagnosis the closed switching valve (JP Laid-Open No. 2003-13810). This method cannot, however, diagnosis the failure of the opened switching valve.

Incidentally, FIG. 3 shows an example of the existing leakage diagnosis system. Shown is the illustrated leakage check module 222 integrating thereinto the pressure reducing pump 230, the orifice 232, and the pressure sensor 234, although these components may not be integrated. Also, the leak check module 222 is attached to an atmosphere side of the canister 212. During the reduction of pressure in the evaporative system for the leakage diagnosis, the switching valve 228 is activated (placed in a shutoff state). Otherwise, the switching valve is deactivated (placed in an open state), thereby connecting the evaporative system 202 to the atmospheric air.

Referring to FIG. 4 which illustrates control by the existing system, after the leak diagnosis begins when a certain diagnosis condition is satisfied, and after the pressure reducing pump is actuated, the switching valve 228 is switched from an opened state (deactivated) to closed state (activated) and the whole system is vacuumed by the pressure reducing pump 230 which pumps atmosphere out of the system, thereby generating a negative pressure within the system. It is determined that there is a leakage below a reference value if the pressure being reduced is below a pressure P2, and that there is a leakage above the reference value if the pressure is not reduced below the pressure P2 after a certain elapsed time. Then, the pressure reducing pump 230 is deactivated and the switching valve 228 is opened (deactivated), and the leak diagnosis ends.

Further, FIG. 5 shows airflow while the switching valve 228 is deactivated and the pressure reducing pump 230 is activated. Also, FIG. 6 shows airflow while the switching valve 228 is activated and the pressure reducing pump 230 is deactivated.

FIGS. 8 and 9 illustrate transition of pressure when the switching valve 228 of the existing system is in failure and remains or becomes fixed in an opened or closed state. In both cases, there is a high possibility that a normal condition is determined when a leakage determination pressure variation ÄP3 (ÄP3=P4−P2) is less than LEAK (wherein LEAK is a certain value set around 0 [kPa]).

Now the operation of the control for the existing system is explained with reference to FIG. 7.

After a program for the control starts in step 302, a determination is made in step 304 as to whether a monitoring condition is satisfied. If the determination in step 304 is "NO", the program ends in step 306. If the determination in step 304 is "YES", then a process for measuring an initial pressure P1 is performed in step 308.

Then performed are a process for activation of the pressure reducing pump in step 310, a process for measuring pressure P2 after a certain time T1 has elapsed in step 312, and a process for calculation of a reference pressure variation ÄP1 (ÄP1=P1−P2) in step 314. Then a determination is made in step 316 whether the reference pressure variation ÄP1 is less than a first reference value for the reference pressure DP11 (ÄP1<DP11).

If the determination in step 316 is "NO", then another determination is made in step 318 whether the reference pressure variation ÄP1 is greater than a second reference value for the reference pressure DP12 (ÄP1>DP12). If the determination in step 316 is "YES", then it is decided in step 320 that the reference pressure variation ÄP1 is extremely low. Then a process to deactivate the pressure reducing pump is performed in step 322, and the program returns in step 324.

If the determination in step 318 is "NO", then a process for activating (closing) the switching valve is performed in step 326. If the determination in step 318 is "YES", then it is decided in step 328 that the reference pressure variation ÄP1 is extremely high. Then the process to deactivate the pressure reducing pump is performed in step 322, and the program returns in step 324.

After the process for activating (closing) the switching valve in step 326, a process to measure a maximum pressure P3 over a predetermined time T2 is performed in step 330. Then performed are a process to calculate a valve switching pressure variation ÄP2 (pressure variation when the switching valve is shifted or switched; ÄP2=P3−P2) in step 332, a process to update a pressure P4 being reduced in step 334, and a process to calculate a leak determination pressure variation ÄP3 (pressure variation for leak diagnosis; ÄP3=P4-P2) in step 336. A determination is made in step 338 whether a certain time T3 has elapsed since activation (close) of the switching valve.

If the determination in step 338 is "NO", then a determination is made in step 340 whether the leak determination pressure variation ÄP3 is below a leak value LEAK (ÄP3<LEAK). If the determination in step 338 is "YES", a process to decide "failure for leakage" is performed in step 342.

Further, if the determination in step 340 is "NO", the program returns to the process for updating the reducing pressure P4 in step 334. If the determination in step 340 is "YES", a process to decide a "normal condition" is performed in step 344.

After the process to decide the "failure for leakage" in step 342 or the process to decide the "normal condition" in step 344, a process to deactivate the pressure reducing pump and deactivate (open) the switching valve is performed in step 346, and the program returns in step 348.

SUMMARY OF THE INVENTION

In order to obviate or at least minimize the above inconvenience, the present invention provides an evaporative fuel control system for an internal combustion engine. In this system, a canister is disposed on an evaporative fuel control passage that connects an intake passage of the engine with a fuel tank to absorb the evaporative fuel. An atmosphere open passage connects the canister with the atmospheric air. A purge valve is located between the intake passage and the canister for a purge control of the evaporative fuel generated in the fuel tank and absorbed by the canister. This system includes a switching valve, a reference pressure detecting means, a pressure reducing means, a leak diagnosis means, and a failure determination means. The switching valve communicates/shuts the atmosphere open passage with/to the atmosphere. The pressure reducing means vacuums or generates a negative pressure inside of the evaporative fuel control system. The leak diagnosis means diagnoses leakage within the evaporative fuel control system by using a reduced pressure in the evaporative fuel control system which is reduced by the pressure reducing means when the switching valve is shifted to shut the atmospheric air, and a reference pressure detected by the reference pressure detecting means. The failure determination means determines whether the switching valve is in failure by using a pressure variation when shifting of the switching valve for the leak diagnosis.

According to the present invention having such configuration, the diagnosis of the failure of the switching valve can be achieved by using the pressure variation used for the leak diagnosis, which eliminates the need for additional system or parts for failure diagnosis.

Accordingly, the diagnosis of the failure of the switching valve can be achieved by using the pressure variation used for the leak diagnosis, which eliminates the need for an additional system or parts for failure diagnosis.

DETAILED DISCLOSURE OF THE INVENTION

The present invention will now be described in specific detail with reference to the accompanying drawings.

Figure 1:
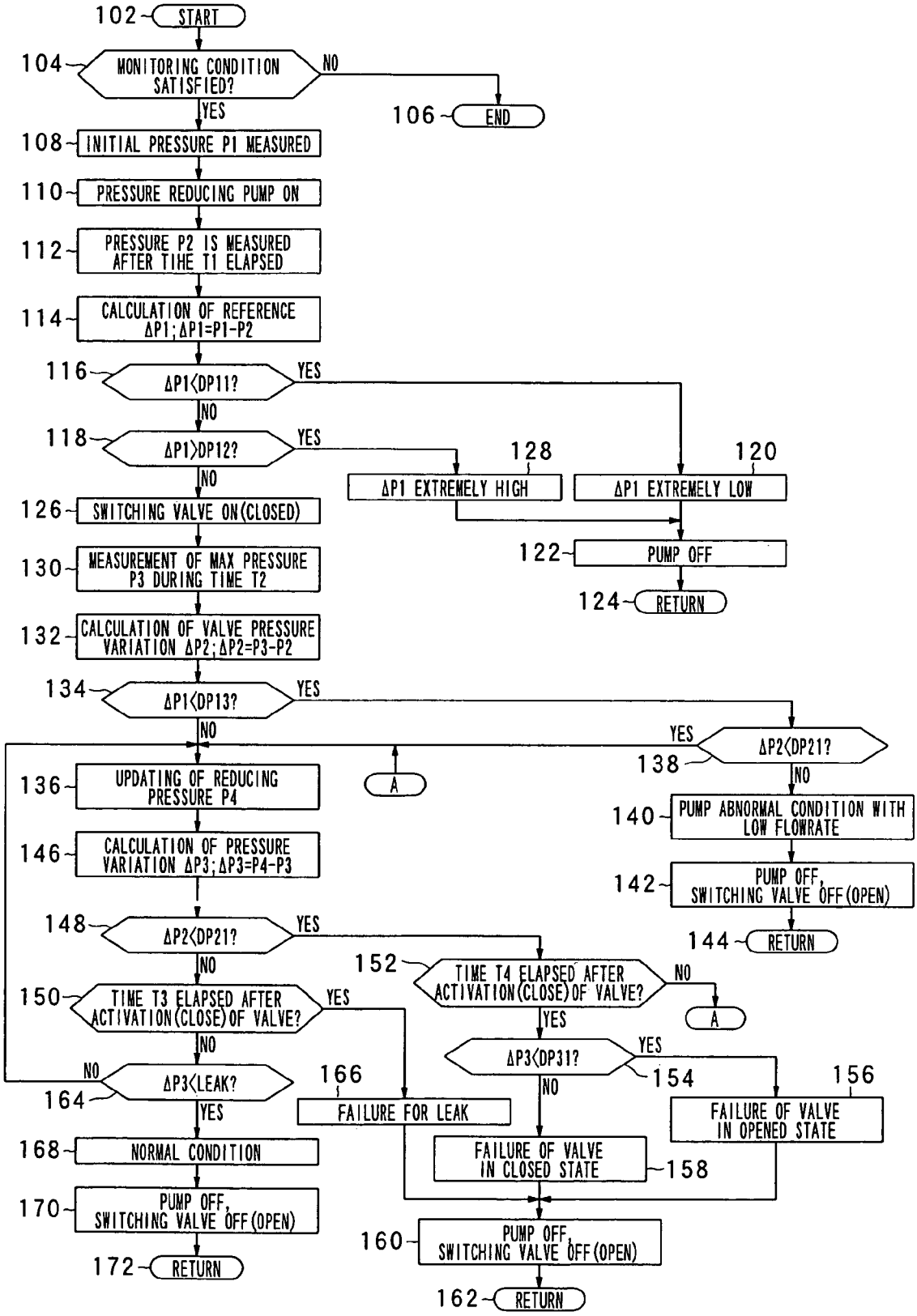
FIG. 1 is a control flowchart for an evaporative fuel control system of an internal combustion engine according to an embodiment of the present invention.
Figure 2:
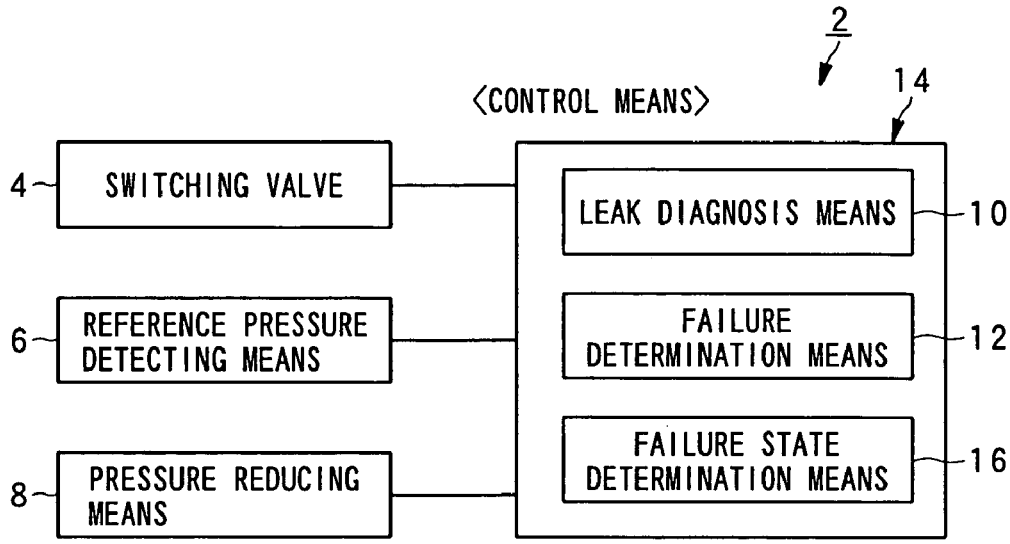
FIG. 2 is a schematic block diagram of the evaporative fuel control system.
Figure 3:
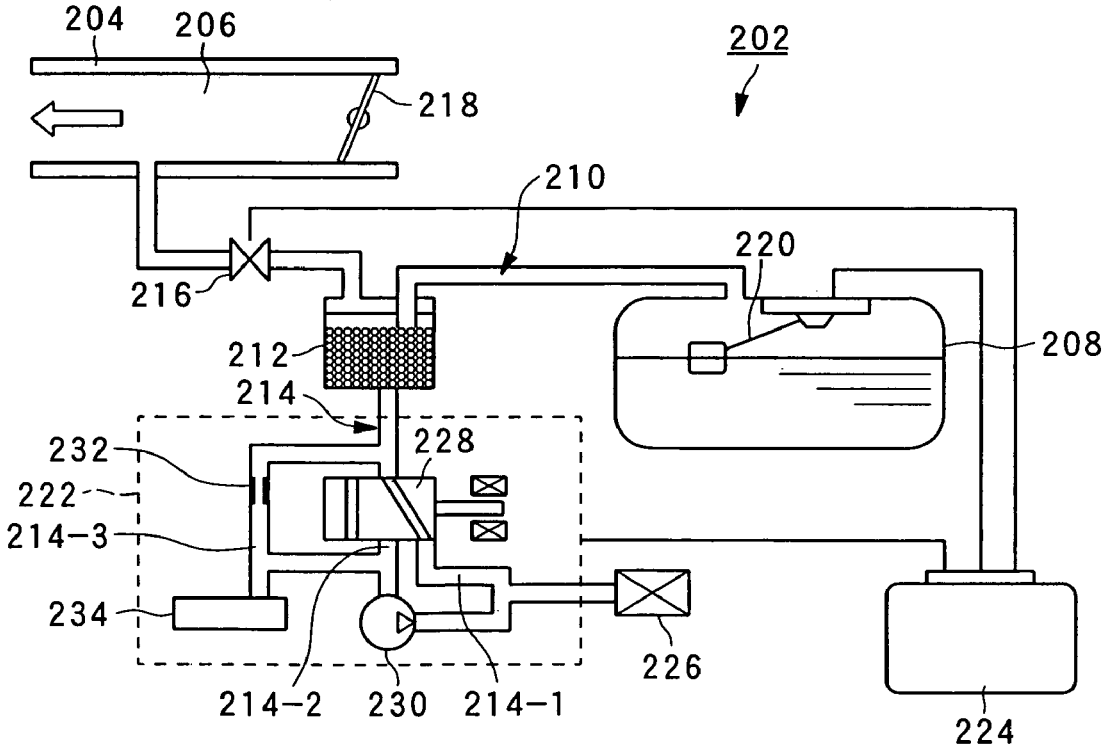
FIG. 3 is a block diagram of a conventional evaporative fuel control system of the engine.

FIGS. 1 and 2 illustrate an embodiment of the present invention. FIG. 2 show an evaporative fuel control system 2 for an internal combustion engine.

See the above-mentioned explanation of the prior art for an explanation of this general configuration of the evaporative fuel control system 2.

Incidentally, in the evaporative fuel control system 2, a canister is disposed on an evaporative fuel control passage (not shown) connecting a fuel tank (not shown) with an intake passage (not shown) in an intake pipe of the engine (not shown) mounted a vehicle (not shown). An atmosphere open passage (not shown) connects the atmosphere with the canister. A purge valve (not shown) is disposed between the intake passage and the canister to supply the evaporative fuel which is generated in the fuel tank and is absorbed by the canister to the intake passage for a purge control.

Also the evaporative fuel control system 2 includes a switching valve 4, a reference pressure detecting means 6, a pressure reducing means 8, a leak diagnosis means 10, and a failure determination means 12. The switching valve 4 communicates the atmosphere open air passage with the atmosphere or shuts the atmosphere open air passage to the atmosphere. The pressure reducing means 8 vacuums or reduces the pressure inside of the evaporative fuel control system. The leak diagnosis means 10 diagnosis the presence or absence of leakage within the evaporative fuel control system 2 by using a reduced pressure in the evaporative fuel control system 2 which is reduced by the pressure reducing means 8 when the switching valve is shifted so as to shut the system off from the atmospheric air, and a reference pressure detected by the reference pressure detecting means 6. The failure determination means 12 determines that the switching valve 4 is in failure by using a pressure variation when switching of the shifting valve for the leak diagnosis.

In particular, the reference pressure detecting means 6 corresponds to, e.g., the pressure sensor 234 of the prior art associated with the leak check module 222 disclosed herein.

Also, the pressure reducing means 8 corresponds to, e.g., the pressure reducing pump 230 of the prior art associated with the leak check module 222 disclosed herein.

As shown in FIG. 2, a control means 14 is connected to the switching valve 4, the reference pressure detecting means 6, and the pressure reducing means 8.

This control means 14 corresponds to, e.g., the above-mentioned control means 224 of the prior art.

The leak diagnosis means 10 and the failure determination means 12 can be integrated into or separated from the control means 14. In the embodiment of the present invention, the leak diagnosis means 10 and the failure determination means 12 are integrated into the control means 14.

As shown in FIG. 2, the leak diagnosis means 10 and the failure diagnosis means 12 are provided within the control means 14. The leak diagnosis means 10 diagnoses leakage in the evaporative fuel control system 2 by using a pressure value P2 which is a pressure reduced by the pressure reducing means 8 in the evaporative fuel control system 8 after a certain time T1 has elapsed, and an initial pressure P1 detected by the reference pressure detecting means 6. The failure determination means 12 determines the failure of the switching valve 4 by using a valve switching pressure variation ÄP2 which is a difference of the pressure at which the switching valve 4 is shifted or switched during diagnosing of the leakage.

In addition, a failure state determination means 16 is provided within the control means 14 as shown in FIG. 2 to determine a failure state of the switching valve 4 by using the pressure variation in the evaporative fuel control system 2 at the leak diagnosis, after failure is determined by the failure diagnosis means 12.

More particularly, according to the embodiment of the present invention, after the measurement of the initial pressure P1, the pressure reducing pump as the pressure reducing means 8 is activated. After a certain time T1 has elapsed, pressure P2 is measured. It is decided that the switching valve 4 is in failure if the valve switching pressure variation ÄP2 (ÄP2=P3-P2) is not more than or equal to a first reference value DP21 for the switching valve pressure. Further, depending on a leak diagnosis pressure variation ÄP3 after a certain time has elapsed, it is determined that the switching valve 4 is in failure either in an opened or closed state.

The relationship between the first, second, third determination values DP11, DP12, DP13 for the reference pressure which is used for determination of the reference pressure variation ÄPI is as follows: DP11<DP13<DP12.

Next, the operation of the embodiment of the present invention is explained with reference to FIG. 1, which illustrates a control flowchart for the evaporative fuel control system 2.

After a program for the control starts in step 102, a determination is made in step 104 as to whether a monitoring condition is satisfied. If the determination in step 104 is "NO", the program ends in step 106. If the determination in step 104 is "YES", then a process for measuring the initial pressure P1 is performed in step 108.

Then performed are a process for activation of the pressure reducing pump in step 110, a process for measuring the pressure P2 after the certain time T1 has elapsed in step 112, and a process for calculation of the reference pressure variation ÄP1 (ÄP1=P1−P2) in step 114. Then a determination is made in step 116 whether the reference pressure variation ÄP1 is less than a first reference value for the reference pressure DP11 (ÄP1<DP11).

If the determination in step 116 is "NO", then another determination is made in step 118 as to whether the reference pressure variation ÄP1 is greater than a second reference value for the reference pressure DP12 (ÄP1>DP12). If the determination in step 116 is "YES", then it is decided in step 120 that the reference pressure variation ÄP1 is extremely low. Then a process to deactivate the pressure reducing pump is performed in step 122, and the program returns in step 124.

If the determination in step 118 is "NO", then a process for activating (closing) the switching valve is performed in step 126. If the determination in step 118 is "YES", then it is decided in step 128 that the reference pressure variation ÄP1 is extremely high. Then the process to deactivate the pressure reducing pump is performed in step 122, and the program returns in step 124.

After the process for activating (closing) the switching valve in step 126, a process to measure a maximum pressure P3 over a predetermined time T2 is performed in step 130. Then a process to calculate the valve switching pressure variation ÄP2 (pressure variation when the switching valve is shifted or switched; ÄP2=P3−P2) is performed in step 132. A determination is made in step 134 whether the reference pressure variation ÄP1 is below the third determination value DP13 for the reference pressure (ÄP1<DP13).

If the determination in step 134 is "NO", then a process for updating the pressure P4 being reduced is performed in step 136. If the determination in step 134 is "YES", then a determination is made in step 138 whether the valve switching pressure variation ÄP2 is below the first determination value DP21 for the switching valve pressure (ÄP2<DP21).

If the determination in step 138 is "YES", the program returns to step 136. If the determination in step 138 is "NO", then performed are a process to decide the reducing pump in an abnormal condition at a low flow rate in step 140, a process for deactivating the pressure reducing pump and deactivating (closing) the switching valve in step 142. Then the program returns in step 144.

After the step 136 for updating the reducing pressure P4, a process for calculating the leak determination pressure variation ÄP3 (pressure variation for leak diagnosis; ÄP3=P4−P2) is performed in step 146. Then a determination is made in step 148 whether the valve switching pressure variation ÄP2 is below the first determination value DP21 for the switching valve pressure (ÄP2<DP21). If the determination in step 148 is "NO", then another determination is made in step 150 whether a certain time T3 has elapsed from the activation (closing) of the valve. If the determination in step 148 is "YES", then another determination is made in step 152 whether a certain time T4 has elapsed from the activation (closing) of the valve.

If the determination in step 152 is "NO", then the program returns to the process for updating the reducing pressure P4 in step 136. If the determination in step 152 is "YES", then a further determination is made in step 154 whether the leak determination pressure variation ÄP3 is below the first determination value DP31 for the leak diagnosis pressure (ÄP3<DP31). If the determination in step 154 is "YES", a process to decide whether the switching valve is in failure in the opened state is performed in step 156. If the determination in step 154 is "NO", then a process to decide whether the switching valve is in failure in the closed state is performed in step 158. After the process in step 156 or 158, a process for deactivating the pressure reducing pump and deactivating (closing) the switching valve is performed in step 160, and then the program returns in step 162.

Further, if the determination at step 150 as to whether a certain time T3 has elapsed from the activation (closing) of the valve is "NO", a further determination is made in step 164 as to whether the leak diagnosis pressure variation ÄP3 is below a leak value LEAK (predetermined value) (ÄP3<LEAK). If the determination in step 150 is "YES", then a process to decide for "failure for leakage" is performed in step 166. After this step 166, a process to deactivate the pressure reducing pump and also deactivate (open) the switching valve is performed in step 160, then the program returns in step 162.

Still further, if the determination in step 164 is "NO", the program returns to step 136. If the determination in step 164 is "YES", a process to decide a "normal condition" is performed in step 168. After this step 168, a process to deactivate the pressure reducing pump and also deactivate (open) the switching valve is performed in step 170. The program then returns in step 172.

With this configuration, the diagnosis of the failure of the switching valve 4 can be achieved by using the pressure variation used for the leak diagnosis, which eliminates the need for an additional system or parts for failure diagnosis. This keeps the system simple and reduces costs, which is advantageous from an economical viewpoint.

The failure diagnosis can also be achieved by using the pressure variation at which the switching valve 4 is activated and deactivated, which improves the precision of the diagnosis.

Also, detailed diagnosis for the switching valve is provided, i.e., the information of the switching valve failure is provided in more detail, which is advantageous in repairing.

The present invention is not limited to the above-mentioned embodiment, but is adaptable for various applications and variations or modifications.

Figure 4:
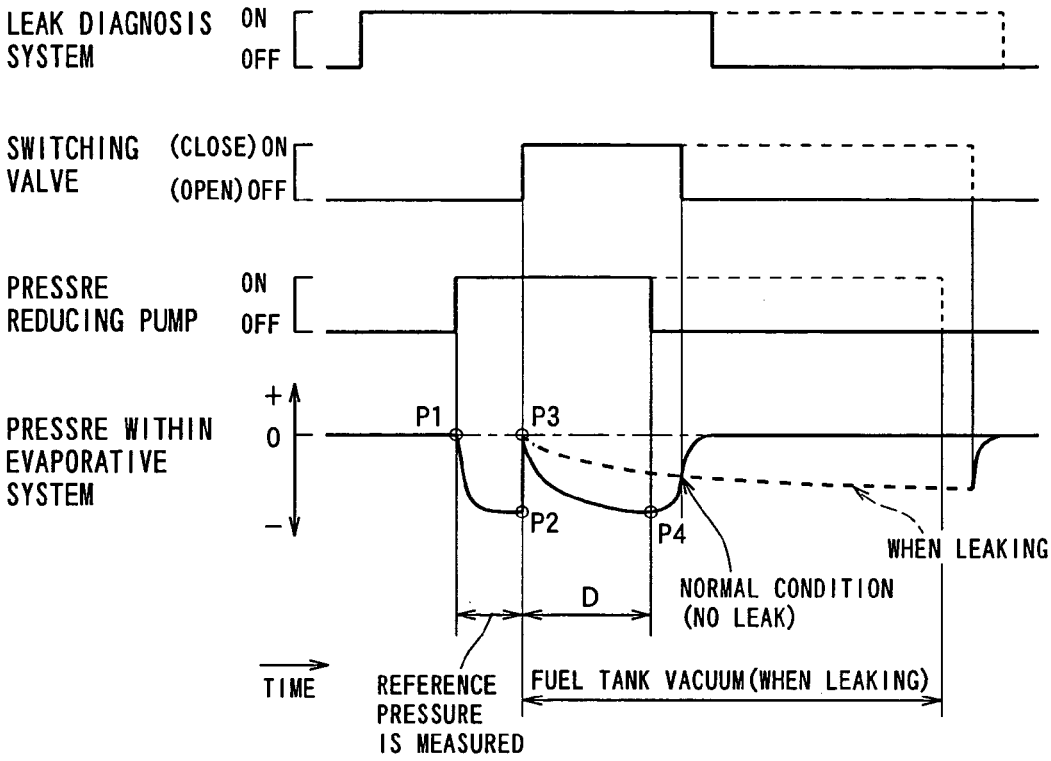
FIG. 4 is a time chart depicting the occurrence of certain events in the conventional evaporative fuel control system of the engine.
Figure 5:
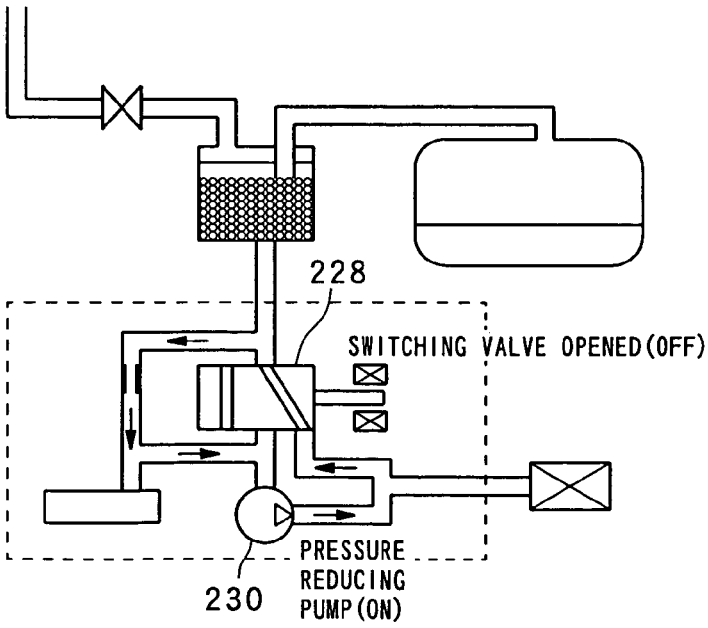
FIG. 5 is a flowchart of airflow when the switching valve is deactivated and the pump is activated.
Figure 6:
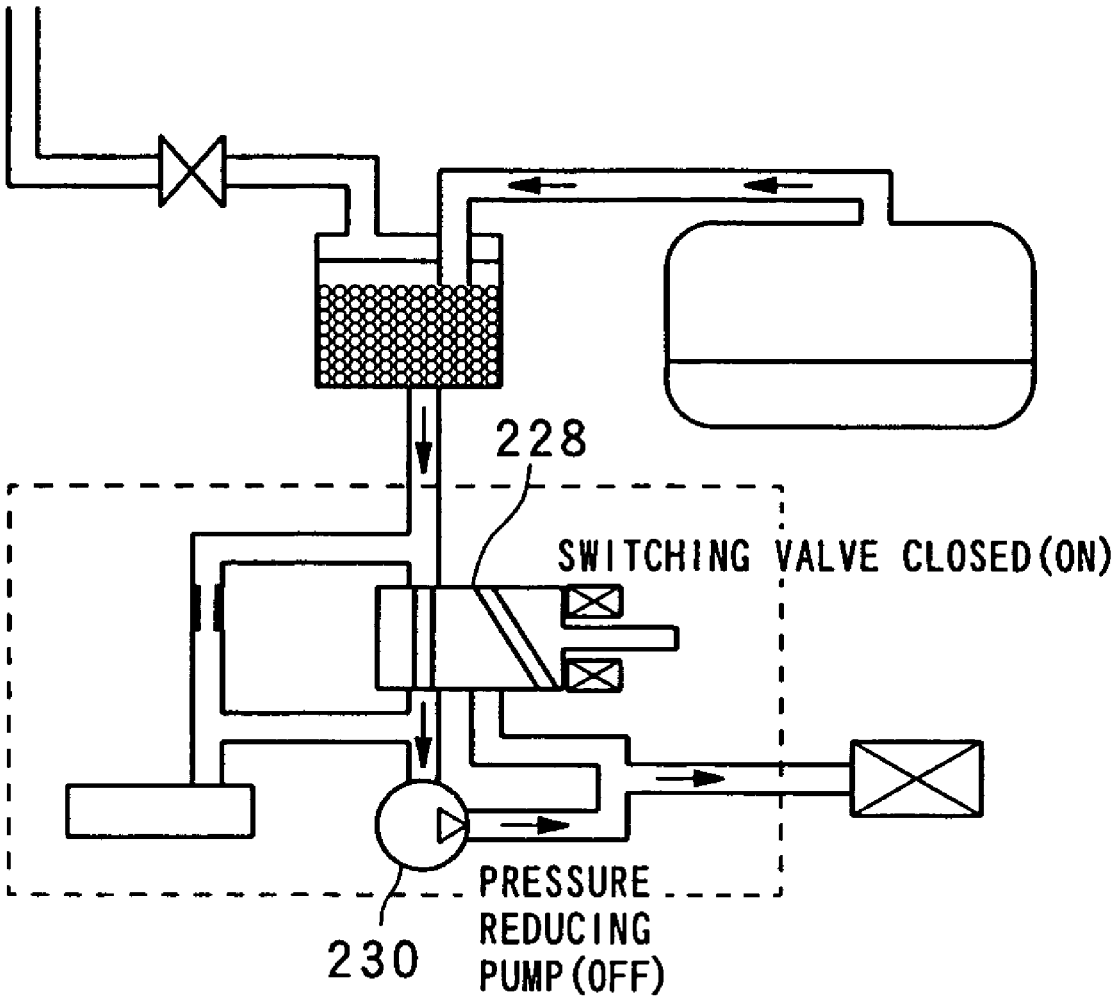
FIG. 6 is a flowchart of airflow when the switching valve is activated and the pump is deactivated.
Figure 7:
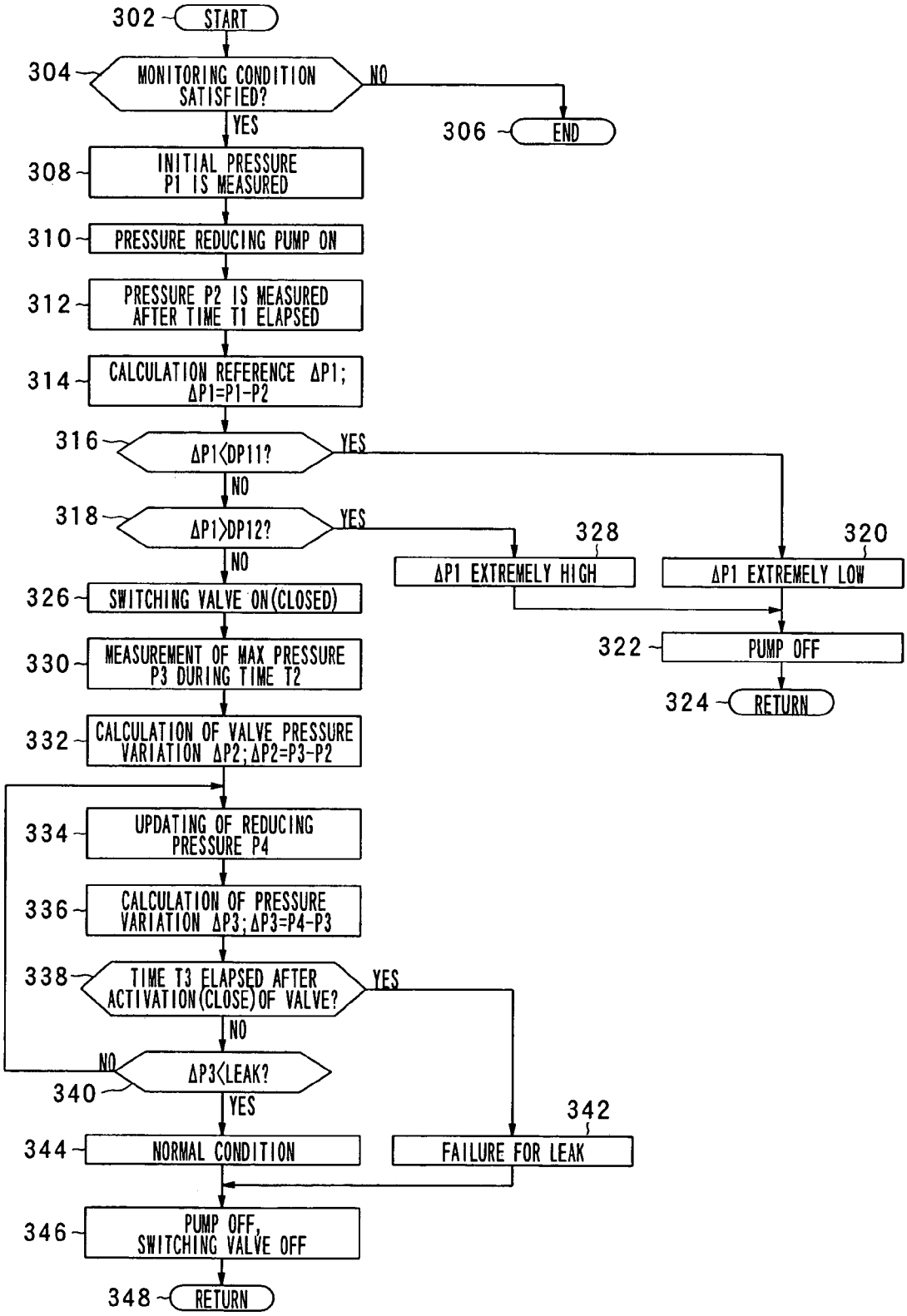
FIG. 7 is a control flowchart for the evaporative fuel control system of the engine.
Figure 8:
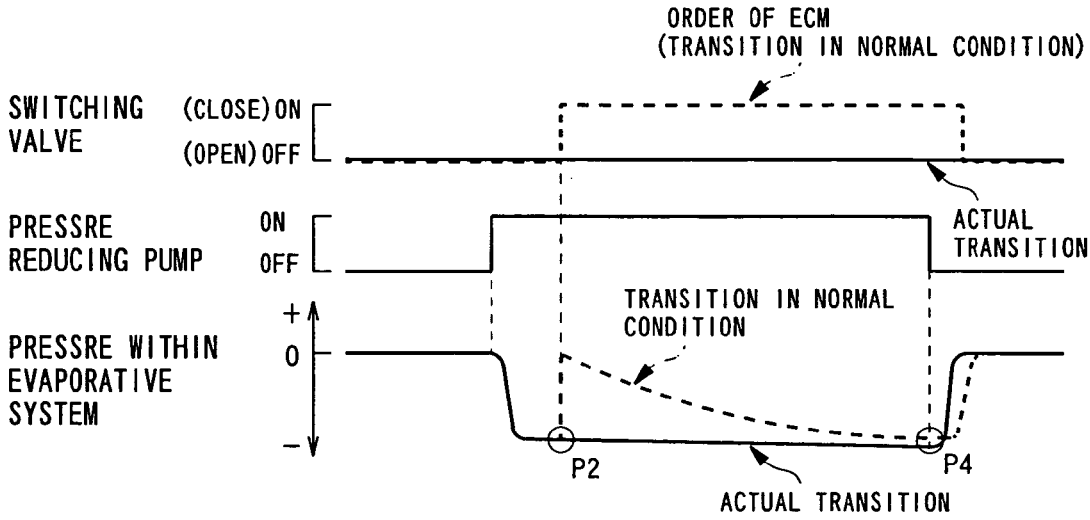
FIG. 8 is a time chart depicting the occurrence of certain events when the switching valve remains in an opened state (failure).
Figure 9:
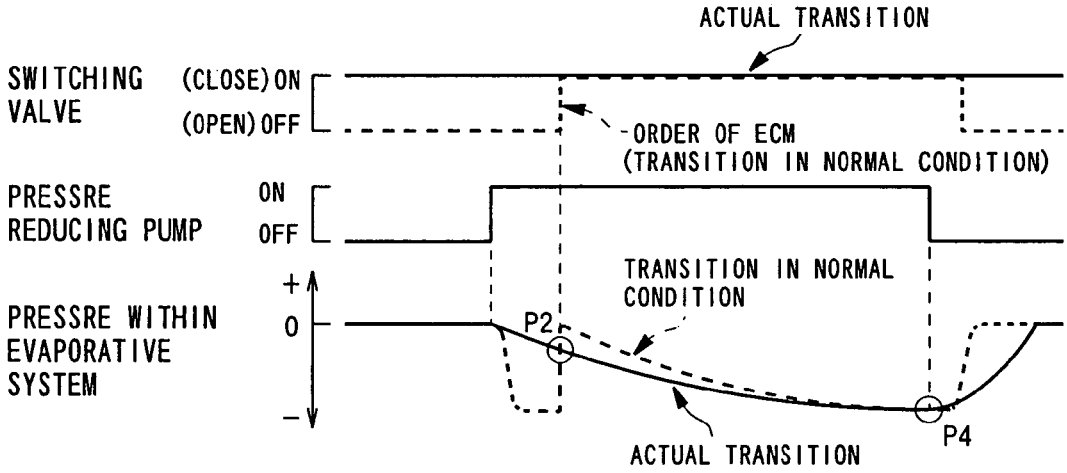
FIG. 9 is a time chart depicting the occurrence of certain events when the switching valve remains in a closed state (failure).

For example, in the embodiment of the present invention, as shown in FIG. 4, the leak diagnosis is performed during vacuuming or pressure reduction in the fuel tank by comparing the reference pressure to the pressure measured when the predetermined time D has elapsed from activation of the switching valve for the fuel tank vacuuming. However, the leak diagnosis can be performed at an earlier stage as a special configuration.

More particularly, as shown in FIG. 4, a normal pressure (without leak; shown in a solid line) and the pressure with leakage (shown in a dashed line) present the different pressure just after activation of the switching valve. It is therefore possible to diagnosis the leakage without waiting for predetermined time D to elapse, which is between the time at which the switching valve is activated and the time the pressure reducing pump is deactivated.

Just after the switching valve is activated, the pressure variation is checked for leakage more than once (e.g., one to three times) at a certain short time interval.

This short time interval can be set at a time shorter in duration than the time D, e.g., time divided into one-fifth or one-tenth of the time D.

As a result, the diagnosis for the leakage is achieved without waiting for predetermined time D to elapse, which is between the time at which the switching valve is activated and the time the pressure reducing pump is deactivated, thereby permitting quick diagnosis control.

What is claimed is:

1. An evaporative fuel control system for an internal combustion engine, comprising:

a canister for absorbing evaporative fuel generated in a fuel tank, said canister being disposed on an evaporative fuel control passage that connects an intake passage of the engine with said fuel tank;

an atmosphere open passage which connects said canister with the atmospheric air;

a purge valve disposed between said intake passage and said canister to supply to the intake passage, for a purge control, the evaporative fuel generated in the fuel tank and absorbed by said canister;

a switching valve to selectively communicate/shut said atmosphere open passage with/to the atmosphere;

a reference pressure detecting means;

a pressure reducing means to vacuum or reduce the pressure inside of the evaporative fuel control system;

a leak diagnosis means to diagnosis leakage within the evaporative fuel control system by using a reduced pressure in the evaporative fuel control system which is reduced by said pressure reducing means when said switching valve is shifted so as to shut off the atmosphere open passage to the atmospheric air, and a reference pressure detected by said reference pressure detecting means; and a failure diagnosis means to determine whether said switching valve is in a state of failure by using a pressure variation when shifting of said switching valve for the leak diagnosis.

2. The evaporative fuel control system for the internal combustion engine as defined in claim 1, further including a failure state determination means to determine a type of failure state occupied by said switching valve by using the pressure variation in the evaporative fuel control system at the leak diagnosis, after failure is determined by said failure diagnosis means.

* * * * *